US007210431B2

(12) United States Patent
Nishikawa et al.

(10) Patent No.: US 7,210,431 B2
(45) Date of Patent: May 1, 2007

(54) COMBUSTION-TYPE POWER TOOL WITH EXHAUST GAS FLOW REGULATING RIB

(75) Inventors: Tomomasa Nishikawa, Hitachinaka (JP); Yoshitaka Akiba, Hitachinaka (JP); Shoichi Hirai, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/311,250

(22) Filed: Dec. 20, 2005

(65) Prior Publication Data

US 2006/0144889 A1 Jul. 6, 2006

(30) Foreign Application Priority Data

Dec. 20, 2004 (JP) ..... P2004-367818

(51) Int. Cl.
*F02B 71/04* (2006.01)

(52) U.S. Cl. ..... 123/46 SC; 123/46 R; 227/9; 227/10

(58) Field of Classification Search ..... 123/46 SC, 123/46 R; 227/8, 9, 10, 11
See application file for complete search history.

(56) References Cited

U.S. PATENT DOCUMENTS 4,403,722 A * 9/1983 Nikolich ..... 227/8
4,522,162 A * 6/1985 Nikolich
5,197,646 A * 3/1993 Nikolich
5,971,245 A * 10/1999 Robinson ..... 227/10
6,431,429 B1 * 8/2002 Canlas et al. ..... 227/130
6,889,885 B2 * 5/2005 Ohmori ..... 227/10
7,063,053 B2 * 6/2006 Hirai et al. ..... 123/46 SC

* cited by examiner

*Primary Examiner*—Stephen K. Cronin
*Assistant Examiner*—Ka Chun Leung
(74) *Attorney, Agent, or Firm*—Antonelli, Terry, Stout & Kraus, LLP.

(57) ABSTRACT

A combustion-type power tool includes a cylinder and a combustion chamber frame disposed to surround the cylinder and movable along the cylinder. A partition wall divides an inner space of an outer frame into a first space in which the cylinder and the combustion chamber frame are disposed and a second space in which a gas cartridge cylinder is disposed and has a through-hole through which the first space and the second space are in fluid communication with each other. A plurality of ribs is formed on an outer surface of the cylinder for regulating an exhaust gas flow generated by combustion of a gaseous mixture in the combustion chamber. The ribs enable exhaust gas discharged from the combustion chamber to be directed away from the through-hole, thereby enabling the gas cartridge cylinder to be maintained at a substantially constant temperature.

15 Claims, 5 Drawing Sheets

COMBUSTION-TYPE POWER TOOL WITH EXHAUST GAS FLOW REGULATING RIB

BACKGROUND OF THE INVENTION

1. Field of the Invention

The present invention relates to a combustion-type power tool, such as combustion-powered fastener-driving tool for driving fasteners, such as nails, into a workpiece.

2. Description of the Related Art

Compressors and hoses as required in conventional compressed-air type power tool are not needed in combustion-type power tools and the combustion-type power tools are good in operability. Various proposals have been made with respect to the combustion-type power tools as disclosed in U.S. Pat. Nos. 5,197,646 and 4,483,474.

Unlike a compressed-air type power tool that uses compressed air as a driving source, the combustion-type power tool requires no compressor and is, therefore, much easier to transport to a construction site or the like. Further, the combustion-type power tool includes an internal power source, such as a battery, so that the tool can be used in any environment without requiring a commercial power supply.

FIG. 6 is a cross-sectional view showing a conventional combustion-type nail gun 101.

In the combustion-type nail gun 101, a cylinder 105 is fixedly disposed within an outer frame 102. A piston (not shown) is slidably movably disposed within the cylinder 105. A combustion chamber frame 119 is disposed to surround the cylinder 105 and movable in the direction in which the piston moves. The outer frame 102 is partitioned by a partition wall 103 into spaces S1 and S2. The cylinder 105 and the combustion chamber frame 119 are accommodated in space S1, and a gas cartridge cylinder 122 in space S2. A through-hole 103*a* is formed in the partition wall 103, allowing spaces S1 and S2 to be in fluid communication with each other. A combustion chamber frame holding rod 125 is generally disposed within space S2. One end of the rod 125 is inserted into the through-hole 103*a* and projected into space S1 so that the end of the rod 125 engages the lower potion of the combustion chamber frame 119. The combustion chamber frame holding rod 125 moves in cooperation with a trigger switch 124 and serves to hold the combustion chamber frame 119 when the trigger switch 124 is turned off.

In use, the nail gun 101 is moved downward toward a workpiece W from the state shown in FIG. 6. When a push lever 121 is brought in abutment with the workpiece W and pushed thereagainst, the push lever 121 moves upward against the biasing force of a spring 120 biasing the push lever 121 downward. The combustion chamber frame 119, which is coupled with the push lever 121 via an arm 131, is also moved upward. In this manner, the combustion chamber frame 119 moves upward along the cylinder 105. Raising the combustion chamber frame 119 to the uppermost position forms a hermetically sealed combustion chamber S by a cylinder head 104, the combustion chamber frame 119, the cylinder 105, and the piston. Specifically, the combustion chamber S is formed by the engagement of the upper inner periphery of the combustion chamber frame 119 with the cylinder head 104, and the engagement of the middle inner periphery of the combustion chamber frame 119 with the cylinder 105. Flammable gas stored in a gas cartridge cylinder 122 is injected into the combustion chamber S. The flammable gas is agitated and mixed with air in the combustion chamber S by a fan 115. A spark plug exposed in the combustion chamber S produces a spark for igniting and burning the gaseous mixture. The combusted gas expands to move the piston downward. A driver blade (not shown) secured to the piston strikes the nail into the workpiece W. A push switch 132 is provided for detecting that the combustion chamber frame 119 has elevated to a predetermined position.

When the piston has downwardly moved to a position near the lower dead center, an exhaust hole formed in the cylinder 105 is open to the atmosphere. High temperature, high pressure combusted gas in the cylinder 105 is discharged out to atmosphere through the exhaust hole and a stop valve disposed in the exhaust hole. Then, the pressure in the combustion chamber S is gradually lowered. When the pressure in the combustion chamber S has reached atmospheric pressure, a check valve is closed to thereby hermetically seal the combustion chamber S. Thermal vacuum caused by rapid cooling of the combustion chamber S draws the piston back to its initial upper dead center shown in FIG. 6.

The user subsequently lifts the nail gun 101 so as to be separated from the workpiece W. When the user releases the trigger switch 124 (turns the trigger switch 124 off), the combustion chamber frame holding rod 125 is disengaged from the lower portion of the combustion chamber frame 119. Due to the biasing force of the spring 120, the combustion chamber frame 119 returns to the initial position shown in FIG. 6. Therefore, the combustion chamber S is not hermetically sealed but is open to atmosphere. In this state, a motor 113 has been driven by a control circuit (not shown) and thus a fan 115 continues rotating. The rotating fan 115 draws fresh air through an inlet 112*a* formed in a cylinder head 112. The fresh air is introduced into the combustion chamber S through a flow channel 128, thereby performing a scavenging operation in which the fresh air introduced into the combustion chamber S expels the exhaust gas remaining in the combustion chamber S.

Continuous nail driving operations with the conventional nail gun 101 accumulate heat generated when the flammable gaseous mixture is combusted, resulting in heating up the nail gun 101, particularly the combustion chamber frame 119 and the cylinder 105. In the scavenging operation performed after the nail driving operation, these heated-up members are cooled. It should be noted that the exhaust gas primarily flows toward the lower portion of the combustion chamber frame 119 and is discharged out to the combustion chamber frame 119 through a discharge port 119*a* and then out to the outer frame 102 through an opening 130.

The through-hole 103*a* formed in the partition wall 103 allows a part of high temperature exhaust gas to pass therethrough. That is, the high temperature gas existing in space S1 in which the cylinder 105 and the combustion chamber frame 119 are accommodated flows into space S2 in which the gas cartridge cylinder 122 is accommodated. As a result, the gas cartridge cylinder 122 is heated up, causing the temperature of the gas cartridge cylinder 122 to increase.

The pressure of the fuel confined in the gas cartridge cylinder 122 changes greatly depending upon the change in temperature. Accordingly, the temperature rise of the gas cartridge cylinder 122 causes a fuel ejection amount to vary and so a constant amount fuel ejection is not ensured. With the combustion-type nail gun 101, the gaseous mixture in the combustion chamber S can be ignited only when the density of the flammable gas is within a predetermined range. If the density of the flammable gas is too low or too high to be outside the predetermined range, the gaseous mixture may not be ignited. Even if the gaseous mixture could successfully be ignited, the output power would be dramatically reduced, prohibiting stable performance of the nail driving operation.

SUMMARY OF THE INVENTION

In view of the foregoing, it is an object of the present invention to provide a combustion-type power tool with a structure capable of maintaining a substantially constant temperature of a gas cartridge cylinder.

It is another object of the present invention to provide a combustion-type power tool with a structure capable of stabilizing an amount of fuel ejected from the gas cartridge cylinder.

It is still another object of the present invention to provide a combustion-type power tool with a structure that ensures ignition of the gaseous mixture in the combustion chamber.

It is yet another object of the present invention to provide a combustion-type power tool with a structure that stably and constantly outputs required power in performing the fastener driving operation.

In order to attain the above and other objects, a combustion-type power tool according to one aspect of the invention includes an outer frame, a gas cylinder cartridge receiving portion, a cylinder head, a combustion chamber frame, a partition wall, and an exhaust gas flow regulating member. In use, a gas cartridge cylinder is placed in the gas cartridge cylinder receiving portion. The cylinder is fixedly disposed within the outer frame. The cylinder head is fixed to the outer frame. The piston is slidably movable along the inner surface of the cylinder. The combustion chamber is disposed within the outer frame to surround the cylinder to be movable along the cylinder. The combustion chamber is formed by the cylinder head, the cylinder, the piston, and the combustion chamber frame when the combustion chamber frame is in abutment with the cylinder head. The combustion chamber is capable of accommodating a gaseous mixture of existing air in the combustion chamber and fuel injected therein from the gas cartridge cylinder. The partition wall is disposed to divide the inner space of the outer frame into a first space in which the cylinder and the combustion chamber frame are disposed and a second space in which the gas cartridge cylinder is disposed. The partition wall is formed with a through-hole through which the first space and the second space are in fluid communication with each other. The exhaust gas flow regulating member is provided for regulating an exhaust gas flow generated by combustion of the gaseous mixture in the combustion chamber so that exhaust gas discharged from the combustion chamber is not directed toward the through-hole.

According to another aspect of the invention, there is provided a combustion-type power tool that includes an outer frame, a gas cartridge cylinder receiving portion, a cylinder head, a combustion chamber frame, a partition wall, and a plurality of ribs. In use, a gas cartridge cylinder is placed in the gas cartridge cylinder receiving portion. The cylinder is fixedly disposed within the outer frame. The cylinder head is fixed to the outer frame. The piston is slidably movable along the inner surface of the cylinder. The combustion chamber is disposed within the outer frame to surround the cylinder to be movable along the cylinder. The combustion chamber is formed by the cylinder head, the cylinder, the piston, and the combustion chamber frame when the combustion chamber frame is in abutment with the cylinder head. The combustion chamber is capable of accommodating a gaseous mixture of existing air in the combustion chamber and fuel injected therein from the gas cartridge cylinder. The partition wall is disposed to divide the inner space of the outer frame into a first space in which the cylinder and the combustion chamber frame are disposed and a second space in which the gas cartridge cylinder is disposed. The partition wall is formed with a through-hole through which the first space and the second space are in fluid communication with each other. The outer surface of the cylinder has a confronting portion confronting the partition wall. The confronting portion is divided into a cylinder-head-side portion and an anti-cylinder-head-side portion with respect to a position of the through-hole. The pair of ribs is formed on the cylinder-head-side portion and extends obliquely with respect to the imaginary longitudinal axis to be apart farther from each other.

According to still another aspect of the invention, there is provided a combustion-type power tool that includes an outer frame, a gas cartridge cylinder receiving portion, a cylinder head, a combustion chamber frame, a partition wall, and a plurality of ribs. In use, a gas cartridge cylinder is placed in the gas cartridge cylinder receiving portion. The cylinder is fixedly disposed within the outer frame. The cylinder head is fixed to the outer frame. The piston is slidably movable along the inner surface of the cylinder. The combustion chamber frame is formed with a discharge port. The combustion chamber is disposed within the outer frame to surround the cylinder to be movable along the cylinder. The combustion chamber is formed by the cylinder head, the cylinder, the piston, and the combustion chamber frame when the combustion chamber frame is in abutment with the cylinder head. The combustion chamber is capable of accommodating a gaseous mixture of existing air in the combustion chamber and fuel injected therein from the gas cartridge cylinder. The partition wall is disposed to divide the inner space of the outer frame into a first space in which the cylinder and the combustion chamber frame are disposed and a second space in which the gas cartridge cylinder is disposed. The partition wall is formed with a through-hole through which the first space and the second space are in fluid communication with each other. The pair of ribs is formed on the outer surface of the combustion chamber frame to extend in the imaginary longitudinal axis along the discharge port.

According to yet another aspect of the invention, there is provided a combustion-type power tool that includes an outer frame, a gas cartridge cylinder receiving portion, a cylinder head, a combustion chamber frame, a partition wall, and a plurality of ribs. In use, a gas cartridge cylinder is placed in the gas cartridge cylinder receiving portion. The cylinder is fixedly disposed within the outer frame. The cylinder head is fixed to the outer frame. The piston is slidably movable along the inner surface of the cylinder. The combustion chamber is disposed within the outer frame to surround the cylinder to be movable along the cylinder. The combustion chamber is formed by the cylinder head, the cylinder, the piston, and the combustion chamber frame when the combustion chamber frame is in abutment with the cylinder head. The combustion chamber is capable of accommodating a gaseous mixture of existing air in the combustion chamber and fuel injected therein from the gas cartridge cylinder. The partition wall is disposed to divide the inner space of the outer frame into a first space in which the cylinder and the combustion chamber frame are disposed and a second space in which the gas cartridge cylinder is disposed. The partition wall is formed with a through-hole through which the first space and the second space are in fluid communication with each other. The plurality of ribs is formed on the outer surface of and in one end portion of the combustion chamber frame and has a portion extending in a direction perpendicular to the imaginary longitudinal axis.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
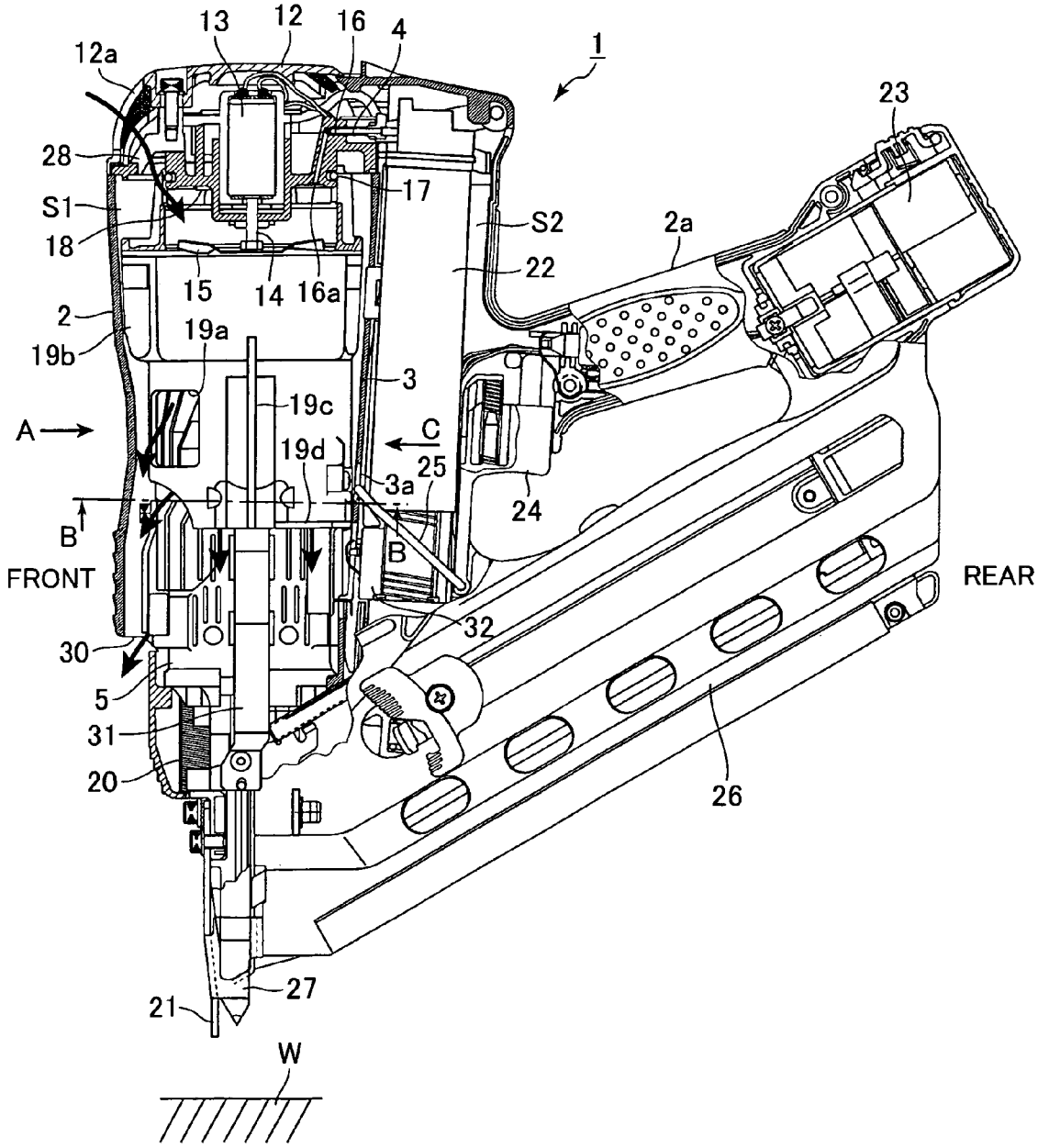
FIG. 1 is a vertical cross-sectional view showing a combustion-powered nail gun according to an embodiment of the present invention.
Figure 2:
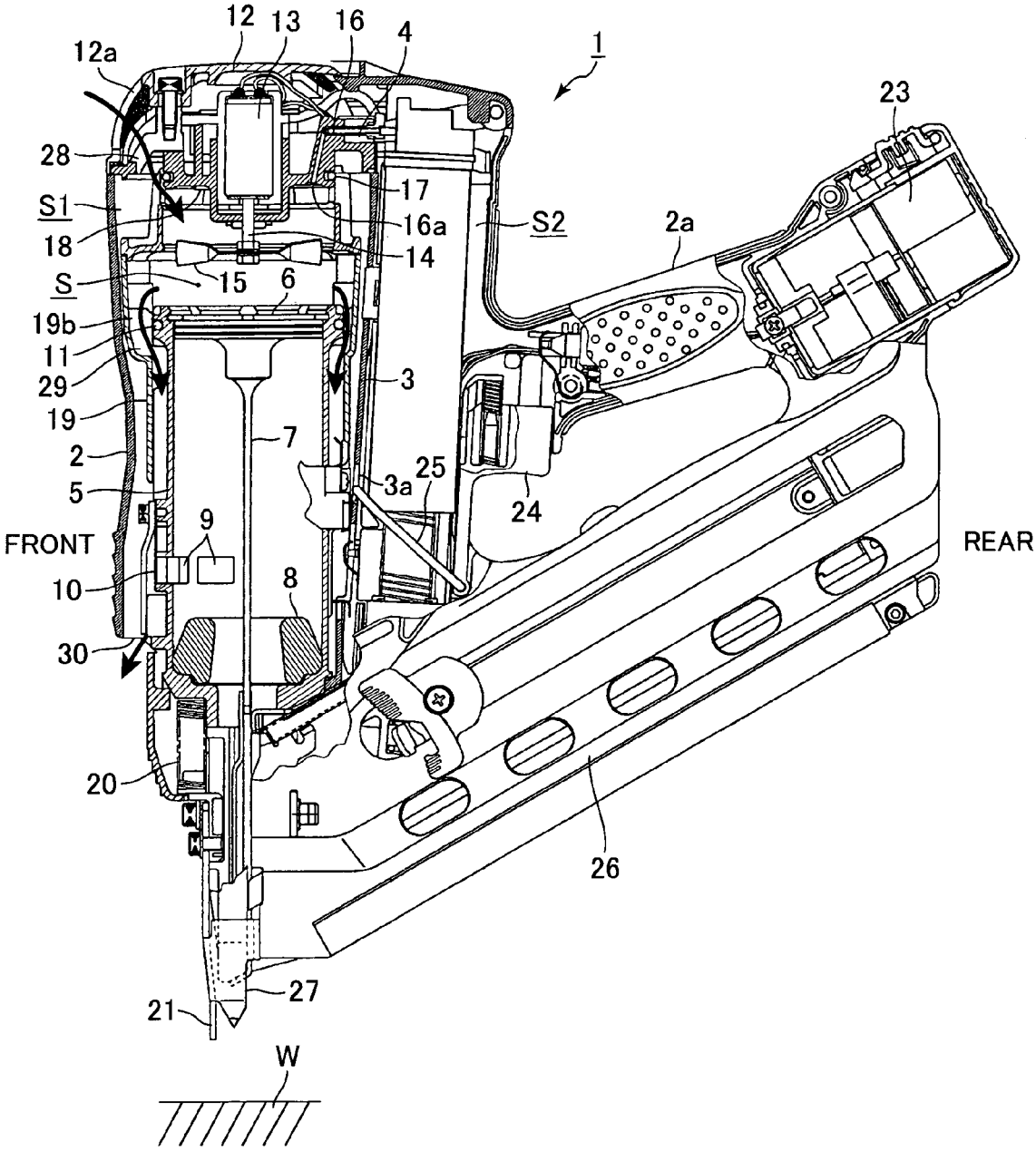
FIG. 2 is another vertical cross-sectional view showing the combustion-powered nail gun shown in FIG. 1.

A combustion-powered nail gun according to one embodiment of a combustion-type power tool will be described with reference to the accompanying drawings. Hereinafter, the terms "upward", "downward", "upper", "lower", "above", "below", "beneath" and the like will be used throughout the description assuming that the combustion-powered nail gun 1 is disposed in an orientation as shown in FIGS. 1 and 2. Also, the terms "front-side" and "rear-side" used hereinafter correspond to "left-side" and "right-side" of FIGS. 1 and 2, respectively.

FIGS. 1 and 2 are vertical cross-sectional views showing a combustion-powered nail gun 1, and particularly a nail-driving tool. The components and operations of the nail-driving tool are described below with reference to FIGS. 1 and 2.

As shown in FIG. 1, the nail gun 1 includes an outer frame 2 that is vertically divided by a partition wall 3 into two spaces S1 and S2 where space S1 is larger than space S2. In space S2, there is provided a gas cartridge cylinder receiving portion where a gas cartridge cylinder is placed at the time of using the nail gun 1.

A cylinder head 4 is fixedly attached to the upper portion of space S1. A cylinder 5 is fixedly disposed below the cylinder head 4. As shown in FIG. 2, a piston 6 is slidably movably disposed within the cylinder 5. A driver blade 7 extends downward from the center of the piston 6. A bumper 8 made from rubber is disposed at the bottom portion of the cylinder 5 against which the piston 6 collides, thereby limiting the downward movement of the piston 6. A plurality of exhaust holes 9 of a rectangular shape is formed in the cylinder 5 in portions near the bumper 8. A check valve 10 is provided in each exhaust hole 9 for selectively opening and closing the exhaust hole 9. When the check valve 10 opens the exhaust hole 9, the exhaust gas is allowed to flow from interior to exterior of the cylinder 5. A seal ring 11 is fitted into the groove formed in the upper outer periphery of the cylinder 5 to hermetically seal the gap between the cylinder 5 and a combustion chamber frame 19 to be described later.

The cylinder head 4 is covered by a head cover 12 attached to the upper portion of the outer frame 2. An intake port 12*a* open to atmosphere is formed in the head cover 12. A motor 13 is disposed in the center portion of the cylinder head 4. The motor 13 has an output shaft (motor shaft) 14 extending downward to which a fan 15 is fixedly attached. The cylinder head 4 is formed with a fuel injection passage 16 which allows the flammable gas to pass therethrough. One end of the fuel injection passage 16 serves as an injection port 16*a* that opens at the lower surface of the cylinder head 4. Another end of the fuel injection passage 16 is in communication with a gas cartridge cylinder 22 (see FIG. 1). The cylinder head 4 has an outer periphery formed with a groove into which a seal ring 17 is fitted. A spark plug 18 is secured to the bottom portion of the cylinder head 4 for generating a spark when a trigger switch 24 is operated.

Figure 3:
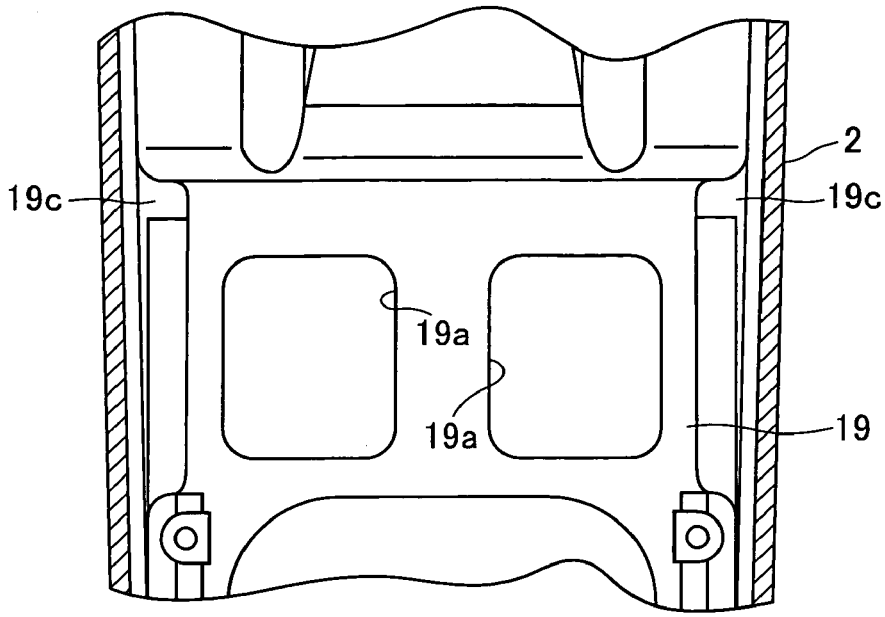
FIG. 3 is a partial vertical cross-sectional view showing a combustion chamber frame accommodated in an outer frame, as viewed from direction A indicated by an arrow in FIG. 1.

The combustion chamber frame 19 is disposed in space S1 to surround the cylinder 5 and is vertically movable along the longitudinal direction of the cylinder 5. The combustion chamber frame 19 is coupled with a push lever 21 via an arm 31 and is constantly biased downward by means of a spring 20. The front-side of the combustion chamber frame 19 (left-side in FIG. 1) is formed with two discharge ports 19*a* of a rectangular shape as shown in FIG. 3. The discharge ports 19*a* are aligned in the circumferential direction of the combustion chamber frame 19. The combustion chamber frame 19 is coupled with a push lever 21 projecting downward from the outer frame 2 and is vertically movable together with the push lever 21. As shown in FIGS. 1 and 2, the upper inner periphery of the combustion chamber frame 19 is formed with a plurality of ribs 19*b*.

The gas cartridge cylinder 22, which stores flammable gas (liquid gas), is detachably accommodated in space S2. A handle 2*a* extending rearwardly of space 2 is also a part of the outer frame 2 of the nail gun 1. A battery 23 used as a power source of the motor 13 is detachably accommodated in the handle 2*a*. The handle 2*a* is provided with the trigger switch 24 with which a combustion chamber frame holding rod 25 is coupled.

As shown in FIGS. 1 and 2, a through-hole 3*a* is formed in the partition wall 3 which divides the outer frame 2 into two spaces S1 and S2, allowing spaces S1 and S2 to be in fluid communication with each other. One end of the combustion chamber frame holding rod 25 extends through the through-hole 3*a* into space S1 so as to selectively engage the lower portion of the combustion chamber frame 119 accommodated in space S1. Another end of the holding rod 25 is coupled with the trigger switch 24.

A magazine 26 filled with a plurality of the nails is detachably provided along the handle 2*a*. A tail cover 27 is disposed between the magazine 26 and the push lever 21 for guiding the nails supplied from the magazine 26 and sequentially setting the nails in a predetermined position in confrontation with the driver blade 7.

As will be described hereinbelow, a plurality of ribs is formed on the outer surface of the cylinder 5 for regulating the exhaust gas flow generated as a result of combustion of a gaseous mixture in a combustion chamber S so that the gas does not flow in the direction toward the through-hole 3*a* formed in the partition wall 3.

Figure 5:
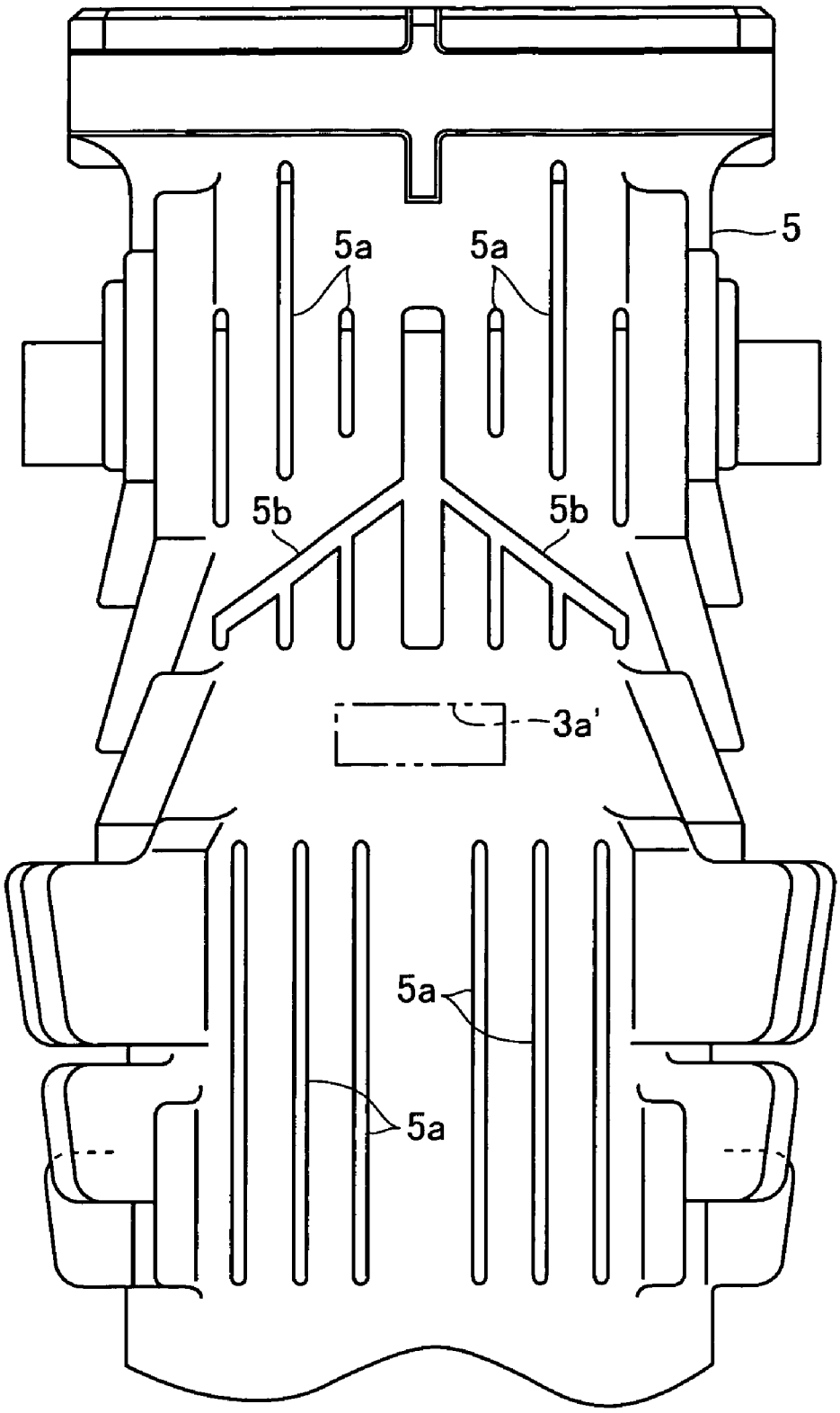
FIG. 5 is a side view showing the surface of a cylinder as viewed from direction C indicated by an arrow in FIG. 1.
Figure 6:
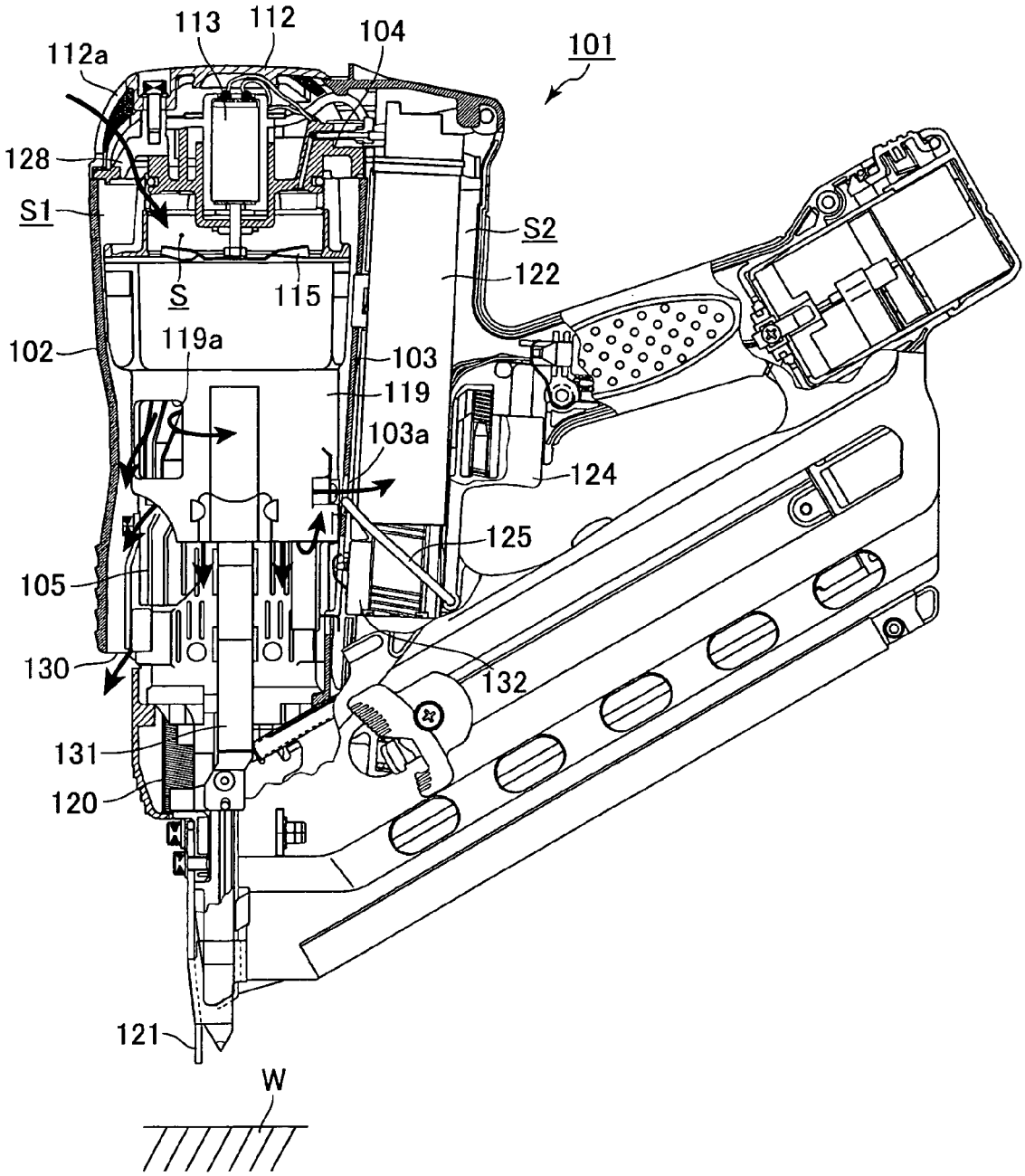
FIG.6 PRIOR ART
FIG. 6 is a vertical cross-sectional view showing a conventional combustion-powered nail gun.

FIG. 5 shows the outer surface of the cylinder 5 facing the partition wall 3, in which the rectangular portion 3*a*' indicated by two-dotted chain line designates the corresponding position of the through-hole 3*a* formed in the partition wall 3. That is, if light is horizontally irradiated toward space 1 from space 2, then the through-hole 3*a* will be projected as the rectangular portion 3*a*' on the outer surface of the cylinder 5. As shown in FIG. 5, a plurality of ribs 5*a*, 5*b* is formed in both the upper and lower parts of the cylinder 5. Here, the upper part of the cylinder 5 refers to the part above the projected through-hole 3*a*', and the lower part thereof refers to the part below the projected through-hole 3*a*'. The exhaust gas generally flows downwardly along the surface of the cylinder 5. However, due to a pair of obliquely formed ribs 5*b*, the exhaust gas flow is directed away from the through-hole 3*a*. The ribs 5*b* are formed in the upper part of the cylinder 5 to obliquely downwardly extend and to be apart farther from each other. The ribs 5*a* extending vertically downward are formed in both the upper and lower parts of the cylinder 5.

Figure 4:
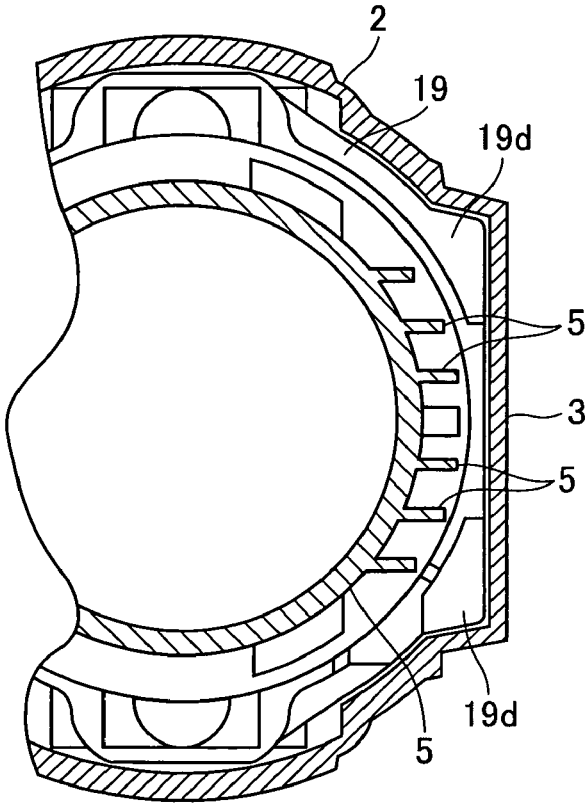
FIG. 4 is a partial horizontal cross-sectional view showing a cylinder and ribs cut along a line B-B indicated in FIG. 1.

As shown in FIGS. 1 and 3, the combustion chamber frame 19 is formed with vertically elongated side shielding ribs 19*c* in opposing sides of the discharge ports 19*a* in order to prevent the exhaust gas from circulating into the space formed between the cylinder 5 and the combustion chamber frame 19 at the rear-side and entering into the through-hole 3*a*. As shown in FIGS. 1 and 4, the combustion chamber frame 19 is further formed with horizontally extending bottom shielding ribs 19*d* in the lower corners at the rear-side of the combustion chamber frame 19. The bottom shielding ribs 19*d* are formed between the outer frame 2 and the combustion chamber frame 19 to shield the gap formed therebetween.

To drive nails into the workpiece W with the nail gun 1, the user grips the handle 2*a* and moves the nail gun 1 downward toward the workpiece W from the initial state shown in FIGS. 1 and 2 in which the push lever 21 is separated from the workpiece W. After the push lever 21 is brought into contact with the workpiece W, the user further pushes the nail gun 1 against the workpiece W. Then, the push lever 21 opposes the biasing force of the spring 20 and the push lever 21 and the combustion chamber frame 19 coupled therewith are upwardly moved so that the combustion chamber frame 19 moves above the cylinder 5. In this state, the inner peripheries of upper and middle portions of the combustion chamber frame 19 are in hermetical contact with the cylinder head 4 and the cylinder 5 with the aid of seal rings 17; 11, respectively. At the same time, flow channels 28, 29 are closed which are formed between the combustion chamber frame 19 and the cylinder head 4 and between the combustion chamber frame 19 and the cylinder 5, respectively. Consequently, a combustion chamber S is formed in which a mixture of a flammable gas and air is burned. The combustion chamber S is a space enclosed by the combustion chamber frame 19, the cylinder head 4, the cylinder 5, and the piston 6.

In accordance with the upward movement of the combustion chamber frame 19, fuel (flammable gas) stored in the gas cartridge cylinder 22 is injected into the combustion chamber S from the fuel injection port 16*a* through the fuel injection passage 16. Here, the flammable gas stored in the gas cartridge cylinder 22 is a pressurized, liquid gas that becomes gasified when injected into the combustion chamber S. When the combustion chamber frame 19 is at the uppermost position and either one of the push switch 32 or the trigger switch 24 is turned on, the motor 13 is driven, causing the fan 15 to rotate. The flammable gas injected into the combustion chamber S is agitated and mixed with air in the combustion chamber S by the fan 15 rotating within the hermetically sealed combustion chamber S in cooperation with the ribs 19*b* protruding inside the combustion chamber S.

When the user pulls the trigger switch 24 provided on the handle 2*a*, the spark plug 18 produces a spark for igniting and burning the gaseous mixture. The combusted gas expands to move the piston 6 downward and the driver blade 7 secured to the piston 6 strikes the nail into the workpiece W. When the trigger switch 24 is pulled by the user, the combustion chamber frame holding rod 25 is brought into engagement with the lower outer surface of the combustion chamber frame 19 to hold the latter and prevent its downward movement.

After striking the nail, the piston 6 collides with the bumper 23, and the discharge ports 9 formed in the cylinder 5 are open to the combustion chamber S. High temperature and high pressure exhaust gas produced in the combustion chamber S is discharged out to atmosphere through the discharge ports 9. As described above, the check valve 10 is disposed in each discharge port 9. This check valve 10 is closed after the combusted gas has been discharged from the cylinder 5 at the point that the interior of the cylinder 5 and the combustion chamber S have reached atmospheric pressure. Again, the combustion chamber S is hermetically sealed by the check valves 10. Cooling down the combustion chamber S creates thermal vacuum, causing the piston 6 to move upward along the cylinder 5 and return to the initial state shown in FIG. 2.

When the user subsequently lifts the nail gun 1 so as to be separated from the workpiece W and then releases the trigger switch 24 (turns the trigger switch 24 off). In accordance with the releasing operation of the trigger switch 24, the combustion chamber frame holding rod 25 is disengaged from the combustion chamber frame 19, allowing push lever 21 and the combustion chamber frame 19 to move downward by the biasing force of the spring 20 and return to the initial state shown in FIGS. 1 and 2. The downward movement of the combustion chamber frame 19 opens the combustion chamber S to atmosphere. At this time, the motor 13 is continuously energized by a control circuit (not shown) so that the fan 15 continues rotating. In this state, the rotating fan 15 draws fresh air through the intake port 12*a* and supplies the fresh air into the combustion chamber S through the flow channel 28. As a result, residual gas is expelled outside the combustion chamber S, thereby scavenging the air in the combustion chamber S.

With the scavenging operation as described above, high temperature exhaust gas (residual gas) is expelled out from the combustion chamber S while flowing through the channel 29. The exhaust gas further flows downwardly to pass through a gap between the combustion chamber frame 19 and the cylinder 5. A part of the exhaust gas flows outside the combustion chamber frame through the discharge ports 19*a* formed in the combustion chamber frame 19, passes through the gap between the outer frame 2 and the cylinder, and discharged to atmosphere through the opening 30 formed at the front-side lower portion of the outer frame 2. At this time, the side shielding ribs 19*c* formed on the outer surface of the combustion chamber frame 19 serve to prevent the exhaust gas from circulating to the rear-side part of the combustion chamber frame 19, i.e., the side opposing the through-hole 3*a* formed in the partition wall 3. Therefore, a major part of the exhaust gas flowing outside the combustion chamber frame 19 through the discharge ports 19*c* is discharged to atmosphere through the opening 30.

The remaining exhaust gas flows downwardly into a space formed between the cylinder 5 and the combustion chamber frame 19. The bottom shielding ribs 19*d* formed at the rear-side lower portion of the combustion chamber frame 19 narrows the gap formed between the combustion chamber frame 19 and the outer frame 2. Thus, the bottom shielding ribs 19*d* serve to prevent the exhaust gas flowing out through the lower opening of the combustion chamber frame 19 from circulating to the gap between the partition wall 2 and the combustion chamber frame 19. The oblique ribs 5*b* formed at the upper part of the rear-side outer surface of the cylinder 5 serve to regulate the exhaust gas flow so that the gas is not directed toward the through-hole 3*a* but directed to the passages that are apart from the through-hole 3*a*. A major part of the exhaust gas flowing in the rear-side gap between the combustion chamber frame 19 and the cylinder 5 is discharged to atmosphere through the opening 30 at the front-side lower end of the outer frame 2.

As described above, with the scavenging operation, the high temperature exhaust gas remaining in the combustion chamber S is prevented from circulating to the rear-side of the combustion chamber frame 19 by the side shielding ribs 19*c*. Also, the exhaust gas is prevented from circulating to the gap between the partition wall 3 and the combustion chamber frame 19 by the bottom shielding ribs 19*d*. The exhaust gas flowing in the rear-side gap between the combustion chamber frame 19 and the cylinder 5 is changed its flow direction by the oblique ribs 5*b* to flow in the front-side. A major part of the exhaust gas flowing in the front-side gap between the combustion chamber frame 19 and the cylinder 5 is discharged from the opening 30 formed at the front-side lower end of the outer frame 2. As such, the exhaust gas flow which may advance toward the through-hole 3*a* formed in the partition wall 3 is blocked. Consequently, temperature rise of the nail gun 1 resulting from successive nail driving operations does not allow high temperature gas to flow into space S2 through the through-hole 3*a*. Therefore, the gas cartridge cylinder 22 is not heated up by the high temperature gas so that the temperature of the gas cartridge cylinder 22 is maintained at substantially constant, ignitions to the gaseous mixture can stably achieved, and the required power can constantly be output by the combustion of the gaseous mixture containing a predetermined density of flammable gas so as to enable stable nail driving operations.

When the push lever 21 is separated from the workpiece W and a predetermined period of time has been expired after the turn-off operation of the push switch 32, the motor 13 is deenergized to stop rotating the fan 15. Then, the nail gun 1 returns to the initial state and is placed to a condition for the subsequent nail driving operation.

While the invention has been described in detail with reference to a specific embodiment thereof, it would be apparent to those skilled in the art that many modifications and variations may be made therein.

For example, while the embodiment describes the nail gun in which the trigger switch 24 is turned on and off each time the nail driving operation is performed, the present invention is applicable to a nail gun of a continuous type in which the nails are driven continuously by holding the trigger switch 24 in on-state and repeatedly carrying out the push-and-release operations with respect to the workpiece

What is claimed is:

1. A combustion-type power tool comprising:

an outer frame having an inner space;

a gas cartridge cylinder receiving portion where a gas cartridge cylinder is placed;

a cylinder having inner and outer surfaces and an imaginary longitudinal axis, the cylinder being fixedly disposed within the outer frame;

a cylinder head fixed to the outer frame;

a piston slidably movable along the inner surface of the cylinder;

a combustion chamber frame having inner and outer surfaces, the combustion chamber frame being disposed within the outer frame to surround the cylinder to be movable along the cylinder, a combustion chamber being formed by the cylinder head, the cylinder, the piston, and the combustion chamber frame when the combustion chamber frame is in abutment with the cylinder head, the combustion chamber being capable of accommodating a gaseous mixture of existing air in the combustion chamber and fuel injected therein from the gas cartridge cylinder;

a partition wall that divides the inner space of the outer frame into a first space in which the cylinder and the combustion chamber frame are disposed and a second space in which the gas cartridge cylinder is disposed, the partition wall being formed with a through-hole through which the first space and the second space are in fluid communication with each other; and an exhaust gas flow regulating member that regulates an exhaust gas flow generated by combustion of the gaseous mixture in the combustion chamber so that exhaust gas discharged from the combustion chamber is directed away from the through-hole.

2. The combustion-type power tool according to claim 1, wherein the exhaust gas flow regulating member further comprises a second plurality of ribs formed on the outer surface of the combustion chamber frame.

3. The combustion-type power tool according to claim 1, wherein the exhaust gas flow regulating member further comprises a third plurality of ribs formed in one end portion of the combustion chamber frame to seal a space between the combustion chamber frame and the outer frame.

4. The combustion-type power tool according to claim 1, wherein the exhaust gas flow regulating member is configured so as to suppress exhaust gas flow from the combustion chamber through the through-hole.

5. The combustion-type power tool according to claim 1, wherein the exhaust gas flow regulating member is configured so as to enable the gas cartridge cylinder to be maintained at a substantially constant temperature during operation of the combustion-type power tool.

6. The combustion-type power tool according to claim 1, wherein the exhaust gas flow regulating member comprises a first plurality of ribs formed on the outer surface of the cylinder.

7. The combustion-type power tool according to claim 6, wherein the first plurality of ribs includes a pair of ribs extending obliquely with respect to the imaginary longitudinal axis so as to extend away from each other.

8. The combustion-type power tool according to claim 7, wherein the pair of ribs is formed on a selected region on the outer surface of the cylinder, the selected region being substantially in opposition to the through-hole.

9. A combustion-type power tool comprising:

an outer frame having an inner space;

a gas cartridge cylinder receiving portion where a gas cartridge cylinder is placed;

a cylinder having inner and outer surfaces and an imaginary longitudinal axis, the cylinder being fixedly disposed within the outer frame;

a cylinder head fixed to the outer frame;

a piston slidably movable along the inner surface of the cylinder;

a combustion chamber frame having inner and outer surfaces, the combustion chamber frame being disposed within the outer frame to surround the cylinder to be movable along the cylinder, a combustion chamber being formed by the cylinder head, the cylinder, the piston, and the combustion chamber frame when the combustion chamber frame is in abutment with the cylinder head, the combustion chamber being capable of accommodating a gaseous mixture of existing air in the combustion chamber and fuel injected therein from the gas cylinder;

a partition wall that divides the inner space of the outer frame into a first space in which the cylinder and the combustion chamber frame are disposed and a second space in which the gas cartridge cylinder receiving portion is disposed, the partition wall being formed with a through-hole through which the first space and the second space are in fluid communication with each other, the outer surface of the cylinder having an opposing portion in opposition to the partition wall, the opposing portion being divided into a cylinder-head-side portion and an anti-cylinder-head-side portion with respect to a position of the through-hole; and a pair of ribs formed on the cylinder-head-side portion and extending obliquely with respect to the imaginary longitudinal axis so as to extend away from each other.

10. The combustion-type power tool according to claim 9, wherein the pair of ribs are configured so as to enable the gas cartridge cylinder to be maintained at a substantially constant temperature during operation of the combustion-type power tool.

11. A combustion-type power tool comprising:

an outer frame having an inner space;

a gas cartridge cylinder receiving portion where a gas cartridge cylinder is placed;

a cylinder having inner and outer surfaces and an imaginary longitudinal axis, the cylinder being fixedly disposed within the outer frame;

a cylinder head fixed to the outer frame;

a piston slidably movable along the inner surface of the cylinder;

a combustion chamber frame having inner and outer surfaces and formed with a discharge port, the combustion chamber frame being disposed within the outer frame to surround the cylinder to be movable along the cylinder, a combustion chamber being formed by the cylinder head, the cylinder, the piston, and the combustion chamber frame when the combustion chamber frame is in abutment with the cylinder head, the combustion chamber being capable of accommodating a gaseous mixture of existing air in the combustion chamber and fuel injected therein from the gas cartridge cylinder;

a partition wall that divides the inner space of the outer frame into a first space in which the cylinder and the combustion chamber frame are disposed and a second space in which the gas cartridge cylinder receiving portion is disposed, the partition wall being formed with a through-hole through which the first space and the second space are in fluid communication with each other; and a pair of ribs formed on the outer surface of the combustion chamber frame to extend in the imaginary longitudinal axis along the discharge port.

12. The combustion-type power tool according to claim 11, wherein the pair of ribs are configured so as to enable the gas cartridge cylinder to be maintained at a substantially constant temperature during operation of the combustion-type power tool.

13. A combustion-type power tool comprising:

an outer frame having an inner space;

a gas cartridge cylinder receiving portion where a gas cartridge cylinder is placed;

a cylinder having inner and outer surfaces and an imaginary longitudinal axis, the cylinder being fixedly disposed within the outer frame;

a cylinder head fixed to the outer frame;

a piston slidably movable along the inner surface of the cylinder;

a combustion chamber frame having inner and outer surfaces, the combustion chamber frame being disposed within the outer frame to surround the cylinder to be movable along the cylinder, a combustion chamber being formed by the cylinder head, the cylinder, the piston, and the combustion chamber frame when the combustion chamber frame is in abutment with the cylinder head, the combustion chamber being capable of accommodating a gaseous mixture of existing air in the combustion chamber and fuel injected therein from the gas cartridge cylinder;

a partition wall that divides the inner space of the outer frame into a first space in which the cylinder and the combustion chamber frame are disposed and a second space in which the gas cartridge cylinder receiving portion is disposed, the partition wall being formed with a through-hole through which the first space and the second space are in fluid communication with each other; and a plurality of ribs formed on the outer surface of and in one end portion of the combustion chamber frame, the plurality of ribs having a portion extending in a direction perpendicular to the imaginary longitudinal axis.

14. The combustion-type power tool according to claim 13, wherein the plurality of ribs are configured so as to enable the gas cartridge cylinder to be maintained at a substantially constant temperature during operation of the combustion-type power tool.

15. A combustion-type power tool comprising:

an outer frame having an inner space;

a gas cartridge cylinder receiving portion where a gas cartridge cylinder is placed;

a combustion chamber frame having inner and outer surfaces, the combustion chamber frame being disposed within the outer frame;

a partition wall that divides the inner space of the outer frame into a first space and a second space, the partition wall being formed with a through-hole through which the first space and the second space are in fluid communication with each other; and an exhaust gas flow regulating member that regulates an exhaust gas flow generated by combustion of a gaseous mixture in the combustion chamber so that exhaust gas discharged from the combustion chamber is not directed toward the through-hole.

* * * * *